US005445374A

United States Patent [19]

Clark, Jr.

[11] Patent Number: 5,445,374

[45] Date of Patent: Aug. 29, 1995

[54] GOLF DRIVING RANGE, SYSTEM AND METHOD FOR RETRIEVING BALLS FROM TARGET CUP

[76] Inventor: Herbert P. Clark, Jr., P.O. Box 2155, Concord, N.H. 03302

[21] Appl. No.: 295,937

[22] Filed: Aug. 25, 1994

[51] Int. Cl.[6] ..... A63B 69/36

[52] U.S. Cl. ..... 273/34 A; 273/35 B; 273/182 R

[58] Field of Search ..... 273/35 B, 182 R, 182 A, 273/34 R, 34 A, 179 D, 179 R

[56] References Cited

U.S. PATENT DOCUMENTS

| | | | |
|---|---|---|---|
| 2,229,382 | 1/1941 | Irwin et al. | 273/182 R |
| 3,037,776 | 6/1962 | Younce | 273/182 A |
| 3,567,223 | 3/1971 | Gentiluomo | 273/35 B |
| 3,708,173 | 1/1973 | Hewson | 273/182 R X |
| 5,219,161 | 6/1993 | Williams | 273/35 B |

*Primary Examiner*—George J. Marlo

*Attorney, Agent, or Firm*—L. Bruce Terry; Kenneth C. Hill

[57] ABSTRACT

A tee area is provided from which contestants may hit golf balls toward flag cups located on a plurality of greens. If a contestant hits a golf ball into a flag cup, a ball sensor detects the presence of the golf ball and a remote indicator announces the presence of such a golf ball in the flag cup. Thereafter, an actuator may be utilized to move a door from a closed position to an open position. When such a door is in the open position, the golf ball is permitted to enter a conduit which extends from the flag cup to a remotely located ball receptacle. The actuator then closes the door and a vacuum pump applies a vacuum to the conduit to move the golf ball from the flag cup to the ball receptacle. Air entering the conduit at the flag cup is filtered to prevent debris or other foreign objects from entering the conduit. The ball receptacle may be made from a transparent material so that the golf ball may be identified as belonging to a particular contestant.

20 Claims, 5 Drawing Sheets

GOLF DRIVING RANGE, SYSTEM AND METHOD FOR RETRIEVING BALLS FROM TARGET CUP

BACKGROUND OF THE INVENTION

1. Technical Field

The present invention relates in general to golf games, and in particular to a golf driving range having an apparatus for identifying a player who makes a hole-in-one. Still more particularly, the present invention relates to a method and apparatus for identifying a golf game player that makes a hole-in-one by remotely retrieving an identifiable ball associated with such a golf game player.

2. Description of the Related Art

Golfing has become an increasingly popular sport in the last few years, perhaps because the game involves an interesting mix of skill and luck. Because of the skill and/or luck required, the greatest accomplishment in golf is making a hole-in-one. The challenge of making a hole-in-one has made hole-in-one contests at driving ranges and golf courses a popular event. Players making a hole-in-one may be publicly recognized and may receive a prize, such as merchandise or cash, or a share of a nassau or side pot. However, conducting such a hole-in-one contest on a typical golf course or driving range may present several problems.

One such problem is identifying when a player or contestant has hit a hole-in-one; that is, identifying when a golf ball has entered a flag cup. Methods presently used for establishing that a ball has been hit into a flag cup include (1) visual monitoring by a contestant or a judge, (2) utilizing a video camera to transmit a picture of the flag cup back to a monitoring area, and (3) utilizing an electronic switch located in the flag cup to detect the presence of a golf ball.

An example of utilizing video cameras to monitor the flag cup is found in U.S. Pat. No. 5,184,824 to Riedinger. The use of a video camera to monitor the occurrence of a hole-in-one is also disclosed in U.S. Pat. No. 5,102,140 to Vincent. One problem with utilizing such video cameras is that a human being must still watch a television monitor with a consistency and alertness so as not to miss the occurrence of a ball entering a flag cup. If the person monitoring the video picture misses the hole-in-one, the use of such video equipment is not worth the expense of installing the equipment.

Examples of utilizing a switch to detect the presence of a golf ball in the flag cup may be found in U.S. Pat. No. 5,163,677 to Foley, in U.S. Pat. No. 2,701,140 to Fortinc, and in U.S. Pat. No. 3,104,879 to Jetton.

Another problem encountered in running a hole-in-one contest is identifying the player or contestant who hit the golf ball into the flag cup. Presently, methods of identifying players who hit a hole-in-one include (1) allowing contestants to identify themselves after hitting a hole-in-one, (2) requiring that each contestant supply golf balls that are uniquely marked with respect to other contestants, (3) utilizing video cameras to document the flight of a golf ball from a particular contestant's tee to the flag cup, and (4) restricting the number of contestants attempting to make a hole-in-one such that only one player is driving a golf ball at any particular time.

The problem with the contestant supplying uniquely identified balls is that there is a chance that two contestants will enter the contest with golf balls having the same identifying marks. Utilizing a video camera to monitor the golf ball from the golf tee to the flag cup presents the problem of capturing the entire golf ball trajectory from tee to flag cup, where the resolution such a video picture is high enough to distinguish two golf balls hit simultaneously so that the true contest winner may be identified. With such a video camera solution, multiple cameras may be required which increase the cost of such a system.

The problem with restricting the number of players attempting a hole-in-one at any one time is that the total number of contestants in the game will be limited because contestants will not tolerate waiting long periods of time between chances to make a hole-in-one. If the total number of contestants is limited, providing such a hole-in-one contest may not be economically feasible.

Another problem which may occur during a hole-in-one contest is that play must usually be halted while someone removes a winning golf ball from the target flag cup. One solution to the problem of retrieving a golf ball without interrupting play involves the use of ball return systems connected to the flag cup. Examples of such ball return systems are disclosed in U.S. Pat. No. 3,599,980 to Harmond et al., U.S. Pat. No. 5,184,824 to Riedinger, in U.S. Pat. No. 2,701,140 to Fortinc, and in U.S. Pat. No. 5,219,161. However, such prior art ball return systems have problems and may not be designed specifically to solve problems arising in conducting a hole-in-one contest.

For example, many prior art ball return systems utilize gravitational force to move golf balls from the flag cup to a collection area. Such gravity operated systems require that all collection tubes or conduits maintain a downward slope from the flag cup to the collection point. This requirement means that the flag cup must be located at a higher elevation than the collection point. Many times the terrain of property available for building a driving range does not permit the installation of such a gravity return system. And if the terrain permits a gravity return system, the slope of the ball return tube or conduit must be carefully monitored and maintained during installation of such a ball return tube or conduit. This increases the cost and complexity of the installation.

Another problem with prior art ball retrieval systems is that they tend to become obstructed by foreign objects in the ball return tube or conduit. For example, rocks, dirt, plant material, or small animals and insects may enter the ball return tube or conduit and prevent the golf ball from moving from the flag cup to the collection area.

Many prior art ball return systems utilize a single tube or conduit to collect golf balls from more than one flag cup and deliver such golf balls to a central collection area. With such a system, golf balls hit into different flag cups may be commingled in the ball return tubes or conduit so that the golf ball entering one flag cup cannot be distinguished from a golf ball entering a second flag cup. If the hole-in-one contest offers different rewards or prizes for golf balls entering different flag cups, then two contestants hitting golf balls into two different flag cups may not be identified according to which contestant hit the golf ball into a particular flag cup. Thus, confusion may arise in awarding prizes having different values to two contestants who hit the golf ball into two different flag cups which require different levels of skill to make a hole-in-one.

SUMMARY OF THE INVENTION

It is therefore one object of the present invention to provide an improved golf game.

It is another object of the present invention to provide an improved golf driving range having an apparatus for identifying a player who makes a hole-in-one.

It is yet another object of the present invention to provide a method and apparatus for identifying a golf game player that makes a hole-in-one by remotely retrieving an identifiable golf ball associated with a golf game player who makes a hole-in-one.

It is another object of the present invention to provide a ball return system that resists malfunctions caused by foreign material entering a ball return tube or conduit.

It is yet another object of the present invention to provide a method and apparatus for conducting a hole-in-one golf contest that is tamper proof, and that gives the players of such a contest a high level of confidence in the honesty and in the integrity of such a contest.

The foregoing objects are achieved as is now described. A tee area is provided from which contestants may hit golf balls toward flag cups located on a plurality of greens. If a contestant hits a golf ball into a flag cup, a ball sensor detects the presence of the golf ball and a remote indicator announces the presence of such a golf ball in the flag cup. Thereafter, an actuator may be utilized to move a trap door from a closed position to an open position. When such a trap door is in the open position, the golf ball is permitted to enter a conduit which extends from the flag cup to a remotely located ball receptacle.

The actuator then closes the trap door and a vacuum pump applies a vacuum to the conduit to move the golf ball from the flag cup to the ball receptacle. Air entering the conduit at the flag cup is filtered to prevent debris or other foreign objects from entering the conduit. The ball receptacle may be made from a transparent material so that the golf ball may be identified as belonging to a particular contestant.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
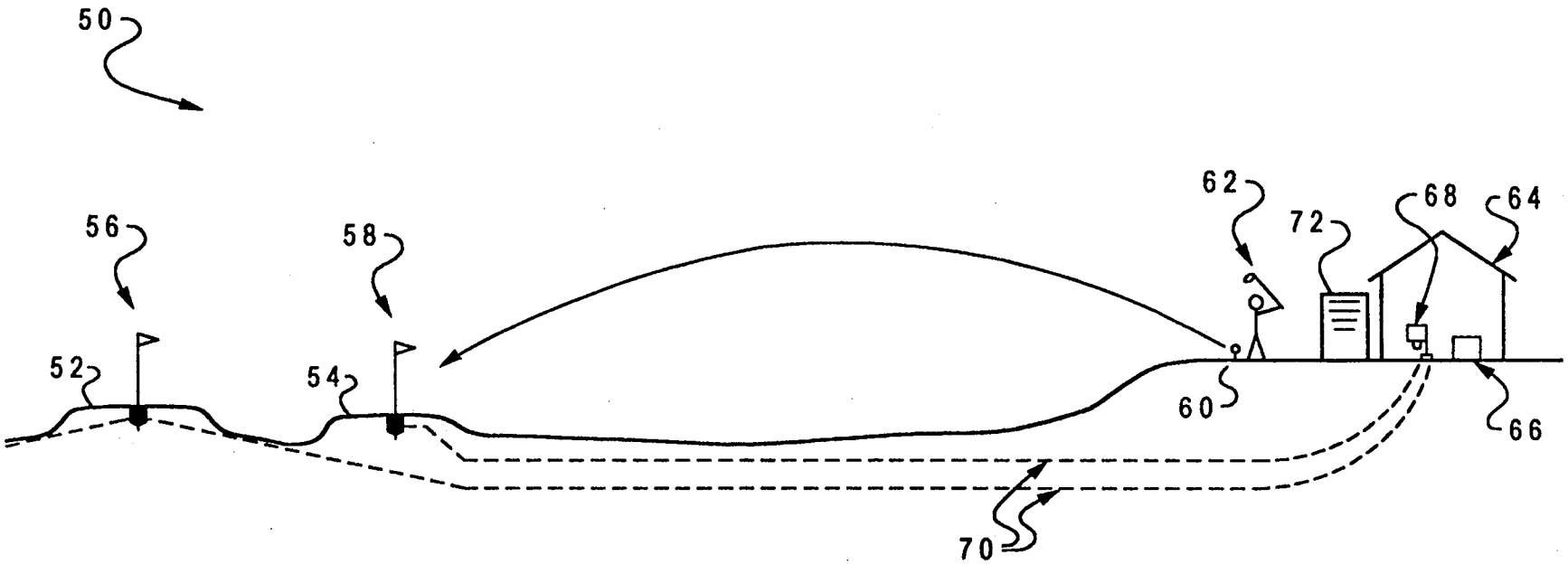
FIG. 1 is an overall view of a driving range in accordance with the method and apparatus of the present invention.

With reference now to the figures and in particular with reference to FIG. 1, there is depicted an overall view of driving range 50. Driving range 50 includes greens 52 and 54, which include flag poles 56 and 58, respectively, for indicating the location of golf cups for receiving a golf ball. Tee area 60 is an area from which contestant 62 may drive or hit a golf ball in an attempt to make a hole-in-one in a golf cup located at either flag pole 56 or 58. Building 64 has been provided to shelter vacuum pump 66 and ball receptacle 68. If contestant 62 hits a hole-in-one at green 52 or 54, vacuum pump 66 may be utilized to retrieve a golf ball from green 52 or 54 to ball receptacle 68 by moving the golf ball through one of conduits 70.

Also included in a preferred embodiment of the present invention is a means for providing identifiable golf balls 72, where such identifiable golf balls may be associated with a particular contestant 62. Such means for providing identifiable golf balls 72 will be discussed in greater detail with reference to FIG. 6 below.

Figure 2:
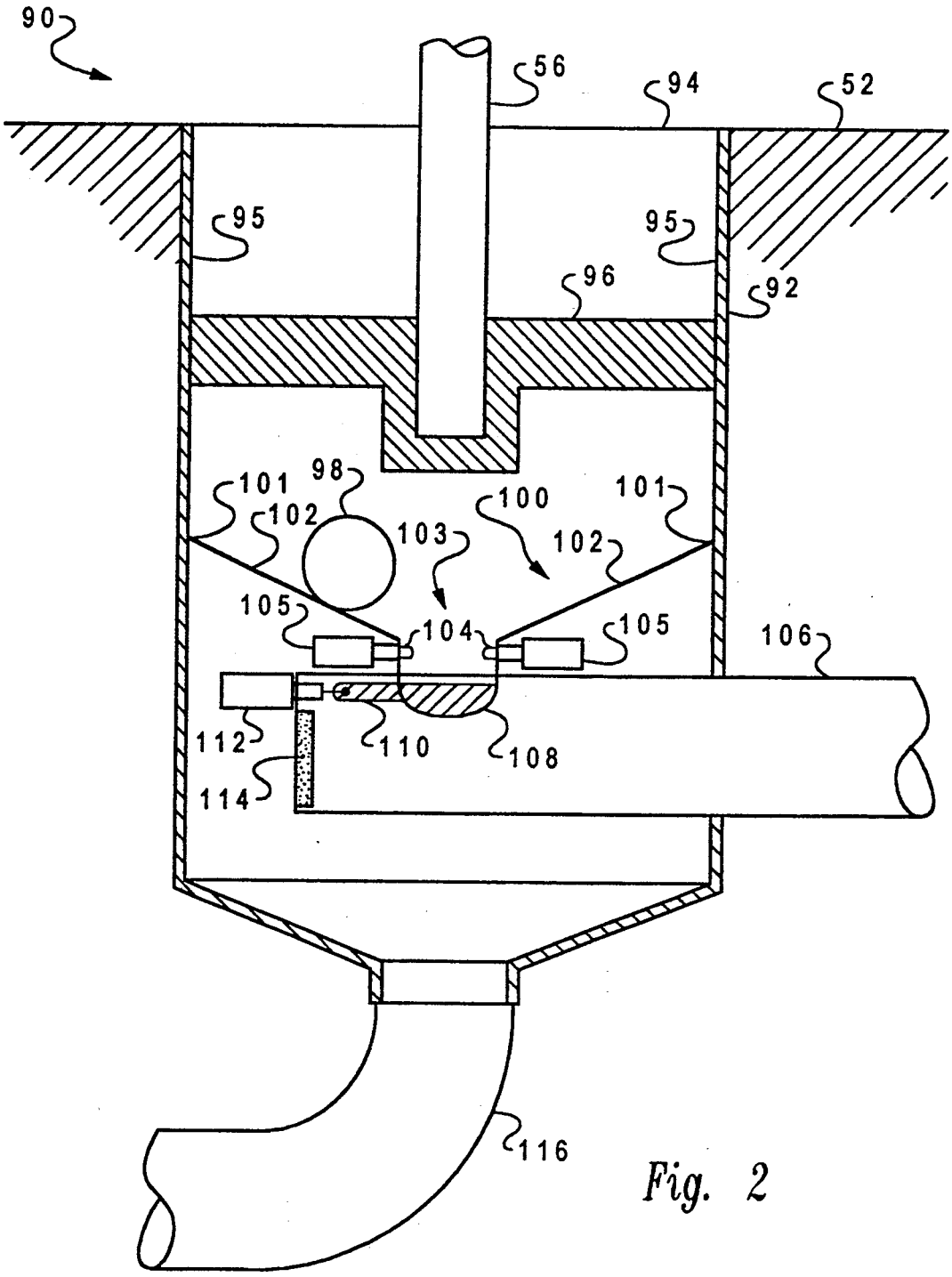
FIG. 2 is a section view of a flag cup in accordance with a preferred embodiment of the present invention.

With reference now to FIG. 2, there is depicted a section view of flag cup 90 in accordance with a preferred embodiment of the present invention. Flag cup 90 includes cup body 92 which is installed near the surface of, and under the ground of, green 52 such that cup opening 94 is even with the surface of green 52. Cup body 92 also includes cup sidewall 95.

Flagpole 56 is vertically supported in the center of cup body 92 by flag support member 96. Flag support member 96 may be securely mounted to the sidewalls of cup body 92. Flag support member 96 has openings (not shown in this figure, see FIG. 3) large enough to allow golf ball 98 to pass through. As golf ball 98 enters cup opening 94, golf ball 98 passes through openings in flag support member 96 and contacts funnel 100. Funnel 100 includes funnel rim 101 and funnel surface 102 which may be sloped downwardly from sidewall 95 of cup body 92 toward the center of cup body 92. Funnel 100 also includes funnel aperture 103, which has a size and shape for permitting the passage of golf ball 98. Funnel aperture 103 may also be referred to as flag cup aperture. Funnel surface 102 may be porous to permit water or other debris to fall to the bottom of cup body 96.

As golf ball 98 rolls and falls into funnel aperture 103, golf ball 98 contacts fingers 104. Fingers are coupled to ball sensors 105, which detect the presence of golf ball 98. In one embodiment of the present invention the movement of fingers 104 caused by golf ball 98 may be utilized to activate a switch within ball sensors 105. Other embodiments of the present invention may utilize other means for detecting the presence of golf ball 98 within flag cup 90.

Ball sensors 104 are preferably calibrated to detect the presence of a golf ball, while also detecting the presence of a foreign object which should not be permitted to enter conduits 70. Such calibration may be implemented by selecting a specific distance between fingers 104, and selecting fingers 104 which require the application of a predetermined force to move fingers 104, so that sensor 105 is more likely to distinguish the presence of a golf ball from the presence of a foreign object. The distance between fingers 104 and the force required to move fingers 104 should be selected such that fingers 104 will contact, and be moved by, the presence of a golf ball near or in aperture 103. Once ball sensors 105 have detected the presence of golf ball 98, ball sensors 105 may transmit a signal via a wire (not shown in this figure) to building 64, wherein an attendant may be notified that a golf ball has entered flag cup 90 on green 52.

The number of fingers 102 and sensors 104 may also be selected so that golf ball 98 activates all sensors 104, while a foreign object (i.e., an object other than a golf ball) will not activate all sensors 104. Therefore, if all sensors 104 are not activated, an indication that a foreign object has entered cup body 92 may be transmitted via a wire (not shown in this figures) to building 64, wherein an attendant may be notified that a foreign object has been detected in cup body 92, where such object may be interfering with the detection of a golf ball. Once an attendant has been notified that a foreign object has entered cup body 92, the attendant may inspect flag cup 90 and remove any foreign object.

Conduit 106 extends through sidewall 95 of cup body 92 and is coupled to the opening or flag cup aperture at the bottom of funnel 100, such that golf ball 98 may pass from the opening at the bottom of funnel 100 into conduit 106. As illustrated in FIG. 2, the opening between the bottom of funnel 100 and conduit 106 is covered by door 108. Door 108 is movably mounted so that in a first position, the opening between funnel 100 and conduit 106 is covered, and in a second position, the opening between funnel 100 and conduit 106 is open so that golf ball 98 may pass from funnel 100 into conduit 106. In one embodiment, door 108 includes arm 110, which may be slidably mounted within conduit 106. Door 108 is moved from the first position to the second position by actuator 112, which is coupled to arm 110.

In an alternate embodiment, door 108 may be pivotally mounted within conduit 106. In this alternate embodiment, the perimeter of pivoting door 108 may include an O-ring (not shown) to more completely seal the opening between 100 and conduit 106 to prevent foreign material from entering conduit 106.

In either embodiment discussed above, actuator 112 may be implemented by an electronic solenoid, which, when activated, causes door 108 to slide or pivot away from the opening of funnel 100.

A second opening into conduit 106 is covered by filter 114. Filter 114 permits air to freely enter conduit 106 while preventing debris, dirt, or other foreign material from entering conduit 106. Filter 114 may be implemented by a wire mesh material, or other known air filtering material. Air filter 114 is selected to permit air to enter conduit 106 in an amount sufficient to move golf ball 98 through conduit 106, when a vacuum is applied to conduit 106 at vacuum pump 66 (see FIG. 1).

Drain pipe 116 is coupled to the bottom of cup body 92. Drain pipe 116 provides for the removal of water and other dirt which may enter cup body 92.

Figure 3:
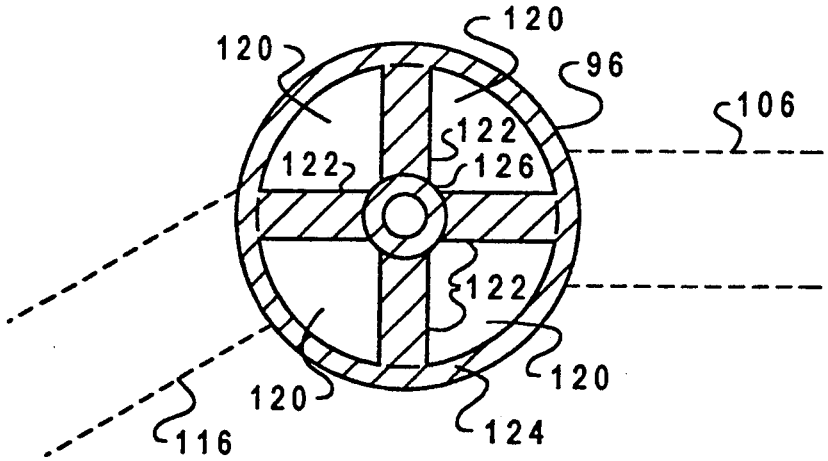
FIG. 3 is a plan view of the flag cup of FIG. 2 in accordance with a preferred embodiment of the present invention.

With reference now to FIG. 3, there is depicted a plan view of flag cup 90 in accordance with a preferred embodiment of the present invention. As illustrated, flag support member 96 includes openings 120 defined by spokes 122 and rim 124. Rim 124 is mounted to cup body 92 (see FIG. 2). Flagpole 56 may be received in hub 126.

Also shown in FIG. 3 is conduit 106 and drain pipe 116. Conduit 106 extends from flag cup 90 to ball receptacle 68 (which is described in greater detail below). Drain pipe 116 channels water and other debris from flag cup 90, and may be terminated outside the perimeter of green 52.

Figure 4:
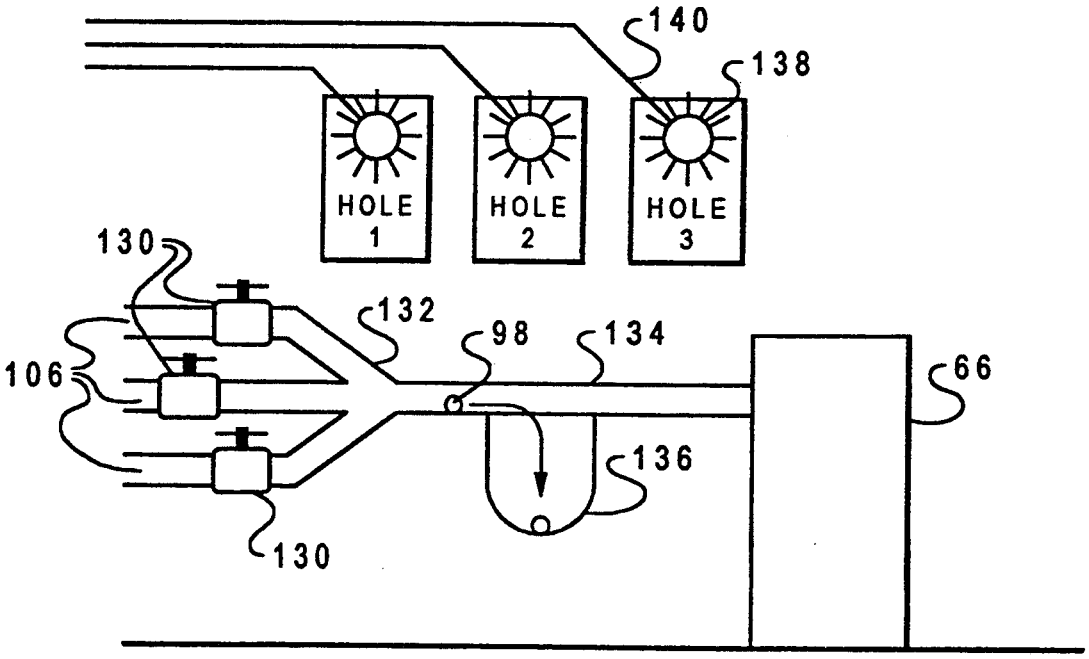
FIG. 4 is a high-level block diagram of a ball receiving area in accordance with a preferred embodiment of the present invention.

With reference now to FIG. 4, there is depicted a high-level block diagram of a ball receiving area in accordance with a preferred embodiment of the present invention. As illustrated, conduits 106 are coupled to valves 130. Valves 130 are coupled to manifold 132 which is coupled to vacuum pump 66. Valves 130 may be selectively opened to apply a vacuum created by vacuum pump 66 to conduits 106. Valves 130 are selected such that, when in an open position, golf ball 98 may pass through valve 130.

Ball receptacle 136 is coupled to the lower side of conduit 134 near an opening in the bottom of conduit 134 which permits golf ball 98 to fall into receptacle 136 as golf ball 98 travels through conduit 134 toward vacuum pump 66. Ball receptacle 136 may be made from a transparent material such that golf ball 98 may be identified as it rests in the bottom of ball receptacle 136. The fact that a golf ball may be retrieved from a flag cup via a conduit and come to rest in ball receptacle 136 without being touched by a human hand may create the impression that a hole-in-one contest conducted with the method and system of the present invention has a high degree of integrity and honesty.

Indicators 138 are utilized to notify an operator that a golf ball has entered a particular golf cup. Indicators 138 are activated by signals received via wires 140 which are coupled to ball sensor 104 in a particular flag cup 90. Indicators 138 may also be utilized to notify an operator that a foreign object has entered a particular golf cup.

Figure 5:
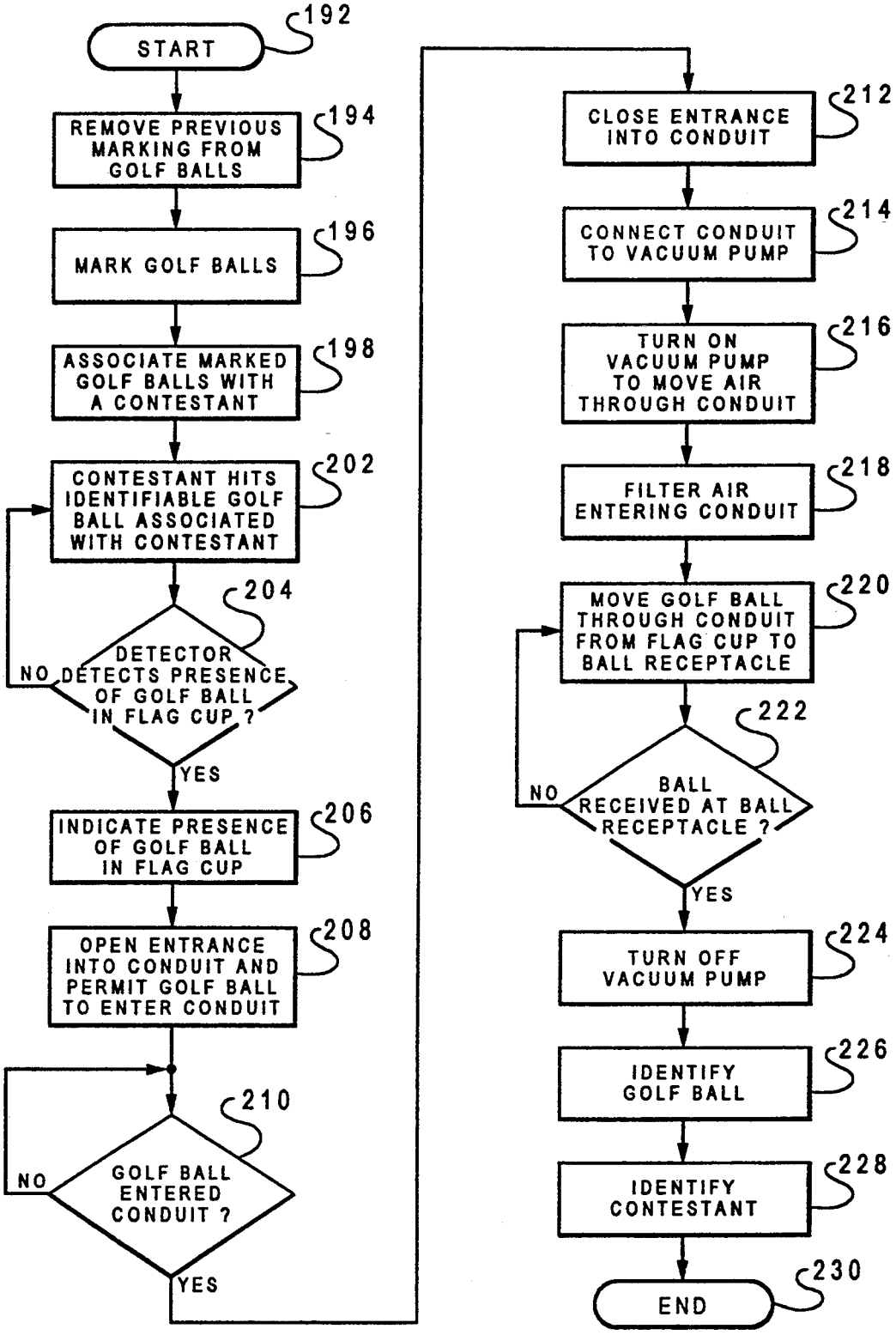
FIG. 5 is a high-level flowchart which illustrates the process of retrieving and identifying a golf ball hit into a flag cup in accordance with the method and system of the present invention.

With reference now to FIG. 5, there is depicted a high-level flowchart which illustrates the process of retrieving and identifying a golf ball hit into a flag cup in accordance with the method and system of the present invention. As illustrated, the process begins at block 192 and thereafter passes to block 194. As depicted at block 194, a previous marking is erased or removed from golf balls. Such golf balls from which the marking is removed may have been collected from driving range 50 after unsuccessfully being hit toward flag pole 56 or 58. In a preferred embodiment, the marking removed from such golf balls is a coloring agent. Of course, if permanent ball marking is utilized, the balls retrieved from driving range 50 will need to be sorted before they may be associated with the next contestant to use them. Or, in the case where each ball has a unique identifier, a group of ball identifiers may be associated with an individual contestant. Because the preferred marking is removed from the golf balls after they are collected from driving range 50, there is no need to sort golf balls into groups having common markings. However, in other embodiments of the present invention, the method of, or means for, identifying golf balls may be permanent, and such permanent marking may include permanently dyed golf balls, printing characters on the golf ball, printing bar codes on the golf balls, installing circuits within the golf ball which may be electronically interrogated, or other similar marking.

In a preferred embodiment, previous markings are removed from golf balls utilizing a ball washing machine such as the ball washing machine sold under the trademark "SCRUB TUB" which is manufactured and sold by Hollrock Engineering, Inc., of Hadley, Ms.

Next, the golf balls are marked (if they are not already permanently marked), as illustrated at block 196. In a preferred embodiment, golf balls are marked by dipping such golf balls in a vat of coloring agent, and allowing the golf balls to dry (see FIG. 6 for an illustration of marking golf balls).

After the golf balls are marked, golf balls having similar markings are associated with a particular contestant, as depicted at block 198. For example, all golf balls marked with a red coloring agent may be associated with a first contestant while all golf balls marked with a green coloring agent may be associated with a second contestant. Thus, if a red golf ball is retrieved from a particular flag cup, the red color may be utilized to identify contestant number 1. The fact that all similarly marked golf balls are associated with a single contestant, and all other golf balls are marked differently enables the identification of a contestant who hit a hole-in-one.

In an alternative embodiment, a record may be made of all unique ball identifiers that have been associated with a particular contestant. For example, if all golf balls have a unique serial number, a record may be made that contestant "A" is driving golf balls with serial numbers "1, 5, 52, .... "

Next, a contestant hits or drives an identifiable golf ball associated with such a contestant. Such an identifiable golf ball includes a means for identifying such a golf ball with respect to other golf balls hit by other contestants. As mentioned previously, golf balls may be identified by color, an indicia printed on the golf ball such as a bar code, serial number, or other identifying mark. Golf balls may also be identified by including electronic circuits within the golf ball which may be queried electromagnetically. The identifiable golf ball may be associated with the contestant by recording the contestants name or tee location together with the identifying characteristics of the identifiable golf ball.

Next, the process determines whether or not a detector in the flag cup has detected the presence of a golf ball in the flag cup, as illustrated at block 204. If the detector has not detected the presence of a golf ball in the flag cup, the process continues at block 202, where contestants continue to hit identifiable golf balls toward the flag cup. If the detector has detected the presence of a golf ball in the flag cup, the process indicates the presence of a golf ball in a particular flag cup on driving range 50 (see FIG. 1 ), as depicted at block 206. Such an indication of the presence of a golf ball in a flag cup may be implemented by lighting a light which indicates which flag cup has a golf ball in it. In an alternative embodiment, such an indication may include a print out on a computer screen.

Additionally, detectors may detect the presence of a foreign object in the flag cup. If such a foreign object is detected, an indicator may be utilized to inform an attendant of the presence of such a foreign object. Thereafter, the attendant may inspect the flag cup and remove the foreign object.

Next, the process opens the entrance into the conduit and permits the golf ball to enter the conduit, as depicted at block 208. The process of opening the entrance to the conduit may be implemented by moving door 108 to an open position by energizing actuator 112 (see FIG. 2). Thereafter, the process determines whether or not the golf ball has entered the conduit, as illustrated at block 210. If the golf ball has not entered the conduit, the process waits for the golf ball to enter the conduit, as illustrated by the no branch from block 210, If the golf ball has entered the conduit, the process closes the entrance or aperture into the conduit, as depicted at block 212. The process of closing the entrance into the conduit may be implemented utilizing door 108, which is moved to a closed position by actuator 112 (see FIG. 2).

Next, the process connects the conduit connected to the appropriate flag cup to the vacuum pump, as illustrated at block 214. Such a process of connecting the conduit to the vacuum pump may be implemented by opening a valve, such as valve 130 (see FIG. 4), which is connected to the conduit running to the appropriate flag cup. A conduit may be connected to more than one flag cup. If this is the case, an attendant may open one door at a time so that one ball may be retrieved at a time. In this manner, the attendant may clearly determine which ball entered a particular flag cup.

Next, the process turns on the vacuum pump to move air through the conduit to urge the golf ball from the flag cup to the ball receptacle, as illustrated at block 216. While the vacuum pump moves air through the conduit, the process filters air entering the conduit, as depicted at block 218. Such a filtering process may be implemented utilizing filter 114 which covers a second opening to conduit 106, as illustrated in FIG. 2.

While the vacuum pump moves air through the conduit, and while the air entering the conduit is filtered, the process moves the golf ball through the conduit from the flag cup to the ball receptacle, as illustrated at block 220. The process then determines whether or not the golf ball has been received at the ball receptacle, as depicted at block 222. If the golf ball has not been received at the ball receptacle, the process continues to move the golf ball through the conduit from the flag cup to the ball receptacle, as illustrated by the "no" branch from block 222. If the golf ball has been received at the ball receptacle, the process turns off the vacuum pump, as depicted at block 224. Thereafter, the golf ball may be identified according to color or other indicia and the identity of the contestant who hit a hole-in-one is determined, as depicted at blocks 226 and 228. Contestants who hit a hole-in-one may be recognized and awarded a prize or a share of a nassau or side pot. The process then terminates as indicated at block 230.

It should be recognized that several processes such as the process illustrated in FIG. 5 may be conducted simultaneously on driving range 50. For example, at any one time, several contestants may hit golf balls, golf balls may be detected in more than one flag cup, or golf balls may be simultaneously moved from different flag cups through different conduits toward the ball receptacle. Thus, one advantage of utilizing the method and system of the present invention is that a hole-in-one contest need not be interrupted when a contestant claims to have hit a hole-in-one. Rather than requiring that other contestants postpone their driving while an attendant retrieves a winning golf ball, the method and system of the present invention provides a means to retrieve a golf ball from a flag cup without interrupting other contestants.

Figure 6:
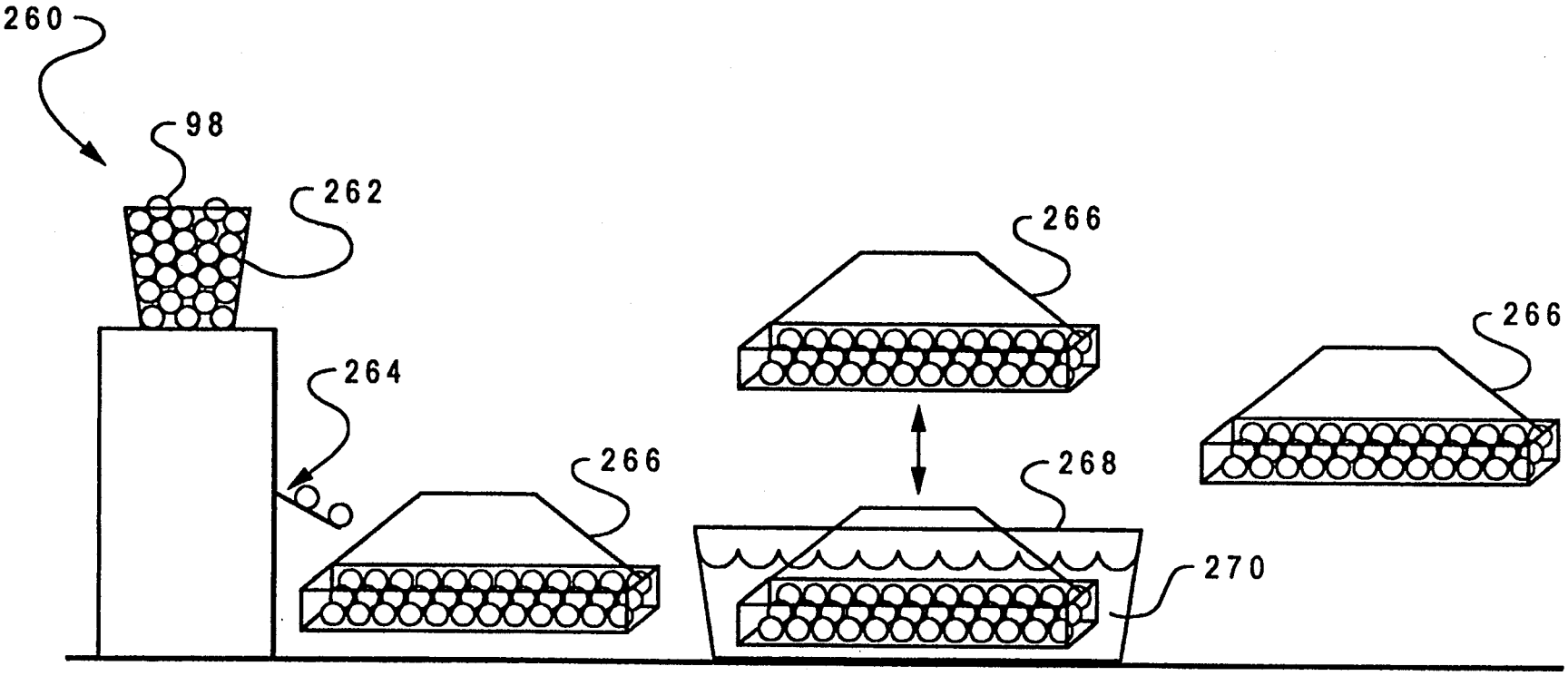
FIG. 6 is a high-level flowchart which illustrates a method and apparatus for providing identifiable golf balls in accordance with a preferred embodiment of the present invention.

With reference now to FIG. 6, there is depicted a method and apparatus for providing identifiable golf balls in accordance with a preferred embodiment of the present invention. As illustrated, ball washer 260 receives golf balls 98 at input hopper 262. Golf balls 98 may have been recently gathered from driving range 50 and, therefore, may include golf balls which have been colored several different colors. Clean, uncolored golf balls leave ball washer 260 at output 264, and are placed in a ball holder, such as basket 266.

Next, basket 266 containing golf balls 98 is submerged in vat 268 which contains coloring agent 270. Coloring agent 270 completely covers golf balls 98 contained in basket 266. All golf balls 98 within a basket 266 are colored according to the color of coloring agent 270.

After dipping, golf balls 98 within basket 266 are permitted to dry. After golf balls 98 are dry, such golf balls distributed to contestants 62.

Although the flag cup has been described and illustrated herein as a relatively small cup buried in a golf green (i.e., a regulation sized cup), such a flag cup may be defined to include a larger ball receiving target which is not necessarily buried. For example, flag cup may be defined to include an above ground, fifty-five-gallon drum, where the conduit and other elements defined by the claims are disposed within such a drum.

While the invention has been particularly shown and described with reference to a preferred embodiment, it will be understood by those skilled in the art that various changes in form and detail may be made therein without departing from the spirit and scope of the invention.

What is claimed is:

1. A golf driving range comprising:

a conduit for transporting a golf ball, said conduit having a first end and a second end;

a golf green having a flag cup therein for receiving a golf ball;

a flag cup aperture, disposed within said flag cup, wherein said flag cup aperture is coupled to a first opening in said first end of said conduit;

a movably mounted door located at said flag cup aperture for selectively opening and closing said flag cup aperture;

an actuator coupled to said door for moving said door for selectively opening and closing said flag cup aperture;

a ball receptacle coupled to said second end of said conduit; and a vacuum pump connected to said conduit at said second end for moving air through said conduit, wherein said golf ball may enter said flag cup, pass through said flag cup aperture when said door opens, move through said conduit when said vacuum pump moves air through said conduit, and be received in said ball receptacle.

2. The golf driving range according to claim I further comprising:

a second opening in said first end of said conduit; and a filter covering said second opening for filtering debris from air entering said conduit.

3. The golf driving range according to claim 1 further comprising:

means for detecting the presence of said golf ball within said flag cup; and means for indicating the presence of said golf ball within said flag cup.

4. The golf driving range according to claim 3 wherein said means for detecting the presence of said golf ball within said flag cup further comprises means for detecting the presence of a foreign object within said flag cup, and wherein said means for indicating the presence of said golf ball within said flag cup further comprises means for indicating the presence of said foreign object within said flag cup.

5. The golf driving range according to claim 1 further comprising:

a plurality of vats of coloring agent, wherein each of said plurality of vats contains a different color of coloring agent;

a ball holder for holding a plurality of said golf balls, wherein said ball holder will fit into said plurality of vats while holding a plurality of said golf balls submerged in said coloring agent for coloring said plurality of golf balls with an identifying color; and a golf ball washer for removing said coloring agent from said golf ball.

6. The golf driving range according to claim I wherein said ball receptacle is transparent.

7. The golf driving range according to claim 1, further comprising:

means for associating an identifiable golf ball with a contestant who will attempt to drive said identifiable golf ball into said flag cup, wherein said identifiable golf ball includes means for distinguishing said identifiable golf ball from other golf balls utilized by other contestants, wherein said contestant who drives said identifiable golf ball into said flag cup may be identified upon receiving said identifiable golf ball in said ball receptacle.

8. A method, in a golf game, for moving a golf ball from a flag cup to a ball receptacle, wherein said flag cup is connected to said ball receptacle via a conduit, said method comprising the steps of:

detecting the presence of said golf ball which has entered said flag cup;

opening an aperture into said conduit and permitting said golf ball to enter said conduit;

closing said aperture into said conduit after said golf ball has entered said conduit;

moving air through said conduit to apply a force to said golf ball to move said golf ball in a direction toward said ball receptacle; and receiving said golf ball in said ball receptacle.

9. The method according to claim 8 further including the step of indicating that said golf ball has entered said golf cup.

10. The method according to claim 8 further including the step of stopping said air movement in said conduit when said golf ball has been received in said ball receptacle.

11. The method according to claim 8 wherein said step of moving air through said conduit to apply a force to said golf ball to move said golf ball in a direction toward said ball receptacle includes the step of applying a vacuum to an end of said conduit near said ball receptacle.

12. The method according to claim 8 further including the step of filtering air that enters said conduit.

13. The method according to claim 8 further including the steps of:

applying a coloring agent to a group of said golf balls;

associating said group of said golf balls with a particular contestant such that said particular contestant utilizes said group of said golf balls having a color of coloring agent that is unique with respect to colors of coloring agents on other golf balls utilized by other contestants; and removing said coloring agent from said golf balls after said golf balls have been utilized by said contestants.

14. The method according to claim 8 further including the step of:

associating an identifiable golf ball with a contestant who will attempt to drive said identifiable golf ball into said flag cup, wherein said identifiable golf ball includes means for distinguishing said identifiable golf ball from other golf balls utilized by other contestants, wherein said contestant who drives said identifiable golf ball into said flag cup may be identified upon receiving said identifiable golf ball in said ball receptacle.

15. A flag cup for use in a golf game, said flag cup comprising:

a cup body having a cup sidewall, a cup opening at an upper end, and a drain opening at a lower end;

a funnel disposed within said cup body between said cup opening and said cup drain opening, wherein said funnel has a funnel rim, a funnel surface having a downward slope from said funnel rim, and a funnel aperture, wherein said funnel rim is coupled to said cup sidewall;

a conduit protruding through said cup body;

a first opening in said conduit coupled to said funnel aperture for passing a golf ball from said funnel aperture into said conduit;

a door movably mounted so that in a first position said funnel aperture is closed to prevent said golf ball from entering said conduit, and in a second position said funnel aperture is open to permit said golf ball to enter said conduit;

an actuator coupled to said door for moving said door between said closed position and said open position;

a second opening in said conduit for allowing air into said conduit; and a filter mounted in said second opening for filtering debris from air entering said second opening.

16. A flag cup for use in a golf game according to claim 15 including means for detecting the presence of a golf ball within said cup body.

17. A flag cup for use in a golf game according to claim 16 wherein said means for detecting the presence of a golf ball within said cup body comprises:

a moveable finger for contacting said golf ball, said finger protruding into said funnel aperture wherein said finger is moveable upon contact by said golf ball; and a switch coupled to said moveable finger, wherein movement of said moveable finger activators said switch.

18. A flag cup for use in a golf game according to claim 17 including a plurality of said moveable fingers coupled to a plurality of said switches, wherein said plurality of said moveable fingers protrude into said funnel aperture such that only the presence of an object having a size and shape similar to said golf ball in said funnel aperture activates all of said plurality of switches.

19. A flag cup for use in a golf game according to claim 15 further including flag support means for supporting a flag to indicate the position of said flag cup.

20. A flag cup for use in a golf game according to claim 15 further including a drain pipe coupled to said cup drain for removing water and debris from said flag cup.

* * * * *